US011712911B2

(12) United States Patent
Yato et al.

(10) Patent No.: US 11,712,911 B2
(45) Date of Patent: Aug. 1, 2023

(54) MEDIUM SUPPLY DEVICE AND RECORDING DEVICE

(71) Applicant: Seiko Epson Corporation, Tokyo (JP)

(72) Inventors: Keiichi Yato, Matsumoto (JP); Akimasa Nozawa, Tatsuno-machi (JP); Mitsuru Murata, Matsumoto (JP); Yosuke Nakano, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/651,188

(22) Filed: Feb. 15, 2022

(65) Prior Publication Data

US 2022/0258497 A1 Aug. 18, 2022

(30) Foreign Application Priority Data

Feb. 18, 2021 (JP) ..... JP2021-024012

(51) Int. Cl.
*B41J 15/02* (2006.01)
*B41J 11/42* (2006.01)

(52) U.S. Cl.
CPC ..... *B41J 15/02* (2013.01); *B41J 11/42* (2013.01)

(58) Field of Classification Search
CPC ..... B41J 15/02; B41J 11/42
See application file for complete search history.

(56) References Cited

FOREIGN PATENT DOCUMENTS

JP 2002-205843 7/2002
WO WO-2014005661 A1 * 1/2014 ..... B65H 16/00

* cited by examiner

*Primary Examiner* — Justin Seo
(74) *Attorney, Agent, or Firm* — Workman Nydegger

(57) ABSTRACT

In a medium supply device, a receiving portion includes a support portion configured to rotatably support a spindle, and a drive gear meshing with a driven gear provided at the spindle to rotate the spindle, and a displacement member includes a pivoting shaft configured to pivot between an advanced position where the spindle is covered and a retracted position where the spindle is exposed, an abutting portion abutting the spindle when the spindle is installed at the receiving portion, the abutting portion being configured to cause the displacement member to pivot to the advanced position, an opposing portion abutting, at the advanced position, an outer peripheral surface of the spindle installed at the receiving portion, a cover portion configured to cover the driven gear, and a grounding member contacting the spindle, thereby coupling to a ground potential.

11 Claims, 10 Drawing Sheets

MEDIUM SUPPLY DEVICE AND RECORDING DEVICE

The present application is based on, and claims priority from JP Application Serial Number 2021-024012, filed Feb. 18, 2021, the disclosure of which is hereby incorporated by reference herein in its entirety.

BACKGROUND

1. Technical Field

The present disclosure relates to a medium supply device and a recording device.

2. Related Art

Recently, as illustrated in JP-A-2002-205843, a printer is known that includes a spindle receiving portion that detachably supports a spindle that holds roll paper.

In the above-described printer, a driven gear is provided at one end of an axis of the spindle, and the spindle receiving portion is provided with a drive gear that meshes with the driven gear to rotate the spindle around the axis. In addition, since the roll paper used in the printer is relatively heavy, a metal spindle is used to reliably hold the roll paper.

For such a printer, a safety function for preventing entry of a user's finger into a rotating portion of the driven gear and an antistatic function of the spindle are required.

SUMMARY

A medium supply device includes a receiving portion configured to receive an electrically conductive spindle including a shaft portion extending through a roll body on which a medium is wound, the spindle being configured to hold the roll body, and a displacement member disposed at the receiving portion and configured to be displaced to an advanced position at which the spindle is covered and a retracted position at which the spindle is exposed, wherein the receiving portion includes a support portion abutting an outer peripheral surface of the shaft portion of the spindle and configured to rotatably support the spindle, and a drive gear meshing with a driven gear provided at an end of the shaft portion of the spindle to rotate the spindle, and the displacement member includes a pivoting shaft configured to pivot between the advanced position and the retracted position, an abutting portion abutting an outer peripheral surface of the shaft portion of the spindle when the spindle is installed at the receiving portion, the abutting portion being configured to cause the displacement member to pivot from the retracted position to the advanced position around the pivoting shaft, an opposing portion abutting, at the advanced position, an outer peripheral surface of the shaft portion of the spindle installed at the receiving portion, a cover portion configured to, at the advanced position, cover the driven gear, and a grounding member contacting, at the advanced position, the spindle, thereby coupling to a ground potential.

A recording device includes a receiving portion configured to receive an electrically conductive spindle including a shaft portion extending through a roll body on which a medium is wound, the spindle being configured to hold the roll body, a displacement member disposed at the receiving portion and configured to be displaced to an advanced position at which the spindle is covered and a retracted position at which the spindle is exposed, and a recording unit configured to perform recording on the medium, wherein the receiving portion includes a support portion abutting an outer peripheral surface of the shaft portion of the spindle and configured to rotatably support the spindle, and a drive gear meshing with a driven gear provided at an end of the shaft portion of the spindle to rotate the spindle, and the displacement member includes a pivoting shaft configured to pivot between the advanced position and the retracted position, an abutting portion abutting an outer peripheral surface of the shaft portion of the spindle when the spindle is installed at the receiving portion, the abutting portion being configured to cause the displacement member to pivot from the retracted position to the advanced position around the pivoting shaft, an opposing portion abutting, at the advanced position, an outer peripheral surface of the shaft portion of the spindle installed at the receiving portion, a cover portion configured to, at the advanced position, cover the driven gear, and a grounding member contacting, at the advanced position, the spindle, thereby coupling to a ground potential.

DESCRIPTION OF EXEMPLARY EMBODIMENTS

First, a configuration of a recording device 10 will be described. The recording device 10 is an ink jet-type large-format printer that performs recording (printing) on a medium M such as paper by discharging liquid (for example, ink). The large-format printer is, for example, a printer capable of performing recording on the medium M having a short side width of not less than A3 (297 mm).

Figure 1:
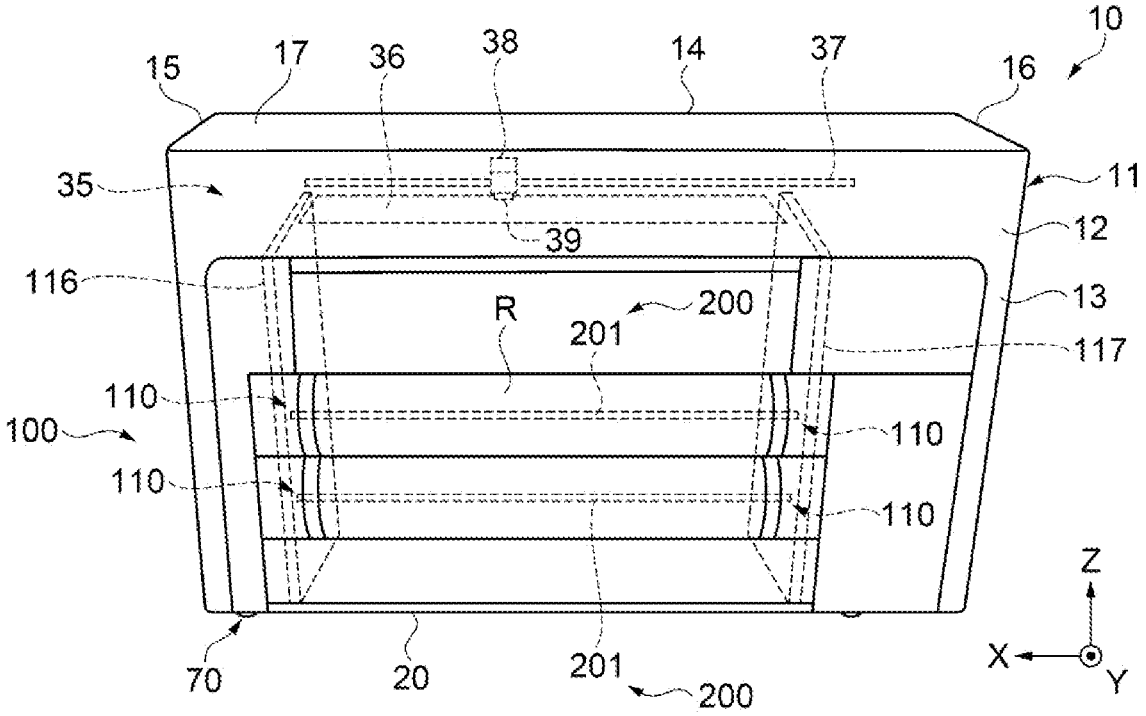
FIG. 1 is a perspective view illustrating a configuration of a recording device.
Figure 2:
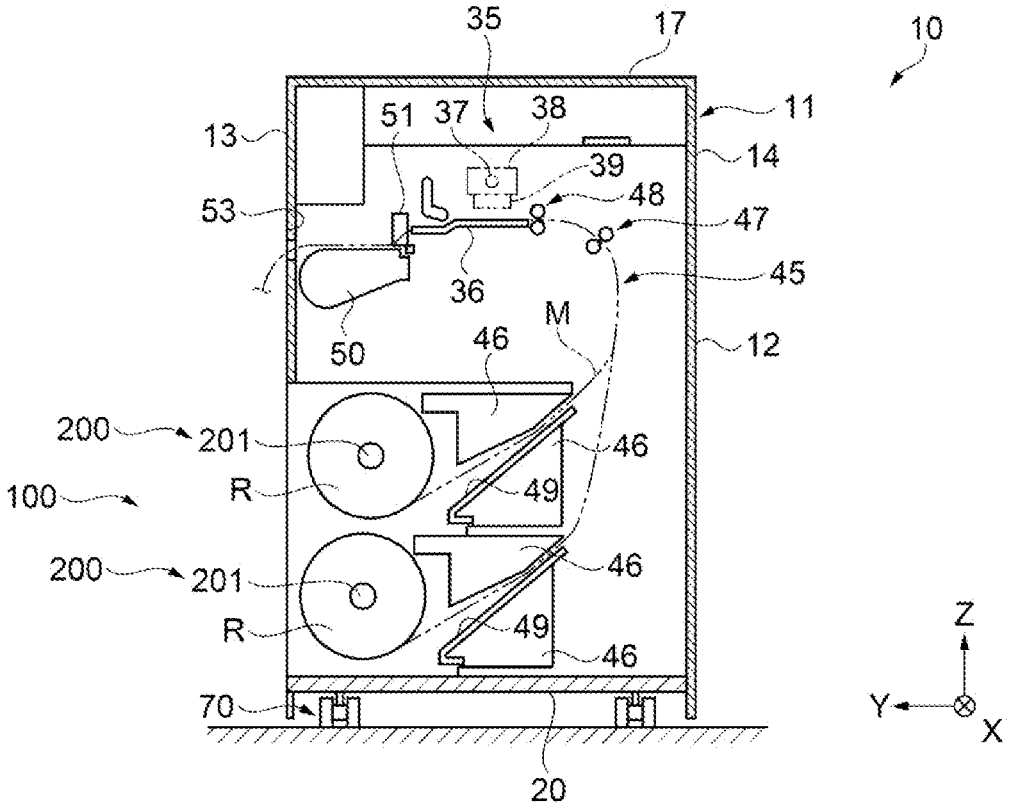
FIG. 2 is a cross-sectional view illustrating the configuration of the recording device.

As illustrated in FIG. 1 and FIG. 2, the recording device 10 according to the present exemplary embodiment includes a medium supply device 100 and a recording unit 35. The recording device 10 supplies the medium M from the medium supply device 100, and records an image, etc. by the recording unit 35 on the medium M to be supplied.

The recording device 10 includes a main body 11 and a leg portion 70. The main body 11 has a housing 12 having a substantially rectangular parallelepiped shape. The housing 12 has a front wall 13, a rear wall 14, a first side wall 15, a second side wall 16, and an upper wall 17. The housing 12 is coupled to a base frame 20 supported by the leg portion 70.

In the recording device 10, a direction in which the base frame 20 and the upper wall 17 face each other is referred to as a height direction of the recording device 10. In addition, a direction along a plane orthogonal to the height direction in which the first side wall 15 and the second side wall 16 face each other is referred to as a width direction of the recording device 10. A direction orthogonal to the width direction in a plane orthogonal to the height direction in which the front wall 13 and the rear wall 14 face each other is referred to as a front-back direction of the recording device 10. In the drawings, a direction along the X-axis is the width direction of the recording device 10, a direction along the Y-axis is the front-back direction, and a direction along the Z-axis is the height direction.

The medium supply device 100 is disposed within the housing 12. Specifically, the medium supply device 100 is disposed in a space formed from the front wall 13 toward the rear wall 14 via an opening provided at the front wall 13 of the housing 12.

The medium supply device 100 includes a receiving portion 110 that receives a spindle 200 as a holding unit that holds a cylindrical roll body R on which the medium M is wound. By setting the spindle 200 holding the roll body R in the receiving portion 110, the roll body R is accommodated in the medium supply device 100. The medium supply device 100 according to the present exemplary embodiment is configured to be able to accommodate the two roll bodies R in a state aligned in the height direction.

A first side frame 116 and a second side frame 117 are disposed at the housing 12. The first side frame 116 and a second side frame 117 are coupled to the base frame 20 and extend in the +Z direction with respect to the base frame 20, and are plate-shaped. The first side frame 116 and the second side frame 117 are disposed spaced apart in a direction along the X-axis. The first side frame 116 is disposed in the +X direction relative to the second side frame 117.

The receiving portion 110 is provided at the first side frame 116 and the second side frame 117. As a result, both ends of the spindle 200 in the direction along the X-axis are supported by the first side frame 116 and the second side frame 117. The spindle 200 can be attached to and removed from the medium supply device 100 (receiving portion 110) via an opening 118 (FIG. 4) provided at the first side frame 116 and the second side frame 117.

Note that the first side frame 116 and the second side frame 117 are metal sheet metal sheets.

The main body 11 includes the recording unit 35 in the housing 12. The recording unit 35 includes a support 36, a guide shaft 37, a carriage 38, and a recording head 39.

The support 36 is disposed on the upper wall 17 side of the medium supply device 100. The support 36 is a plate-shaped member extending in the width direction in the housing 12. After the medium M fed from the roll body R is transported in the housing 12 to the support 36, the medium M is transported on the support 36 from the rear wall 14 side toward the front wall 13 side (+Y direction).

The guide shaft 37 is disposed on the upper wall 17 side of the support 36. The guide shaft 37 is a rod-shaped member extending in the X direction. The guide shaft 37 movably supports the carriage 38 along the guide shaft 37. The carriage 38 is configured to be reciprocally movable along the X-axis along the guide shaft 37 by the drive of the motor.

The recording head 39 is mounted on the carriage 38. The recording head 39 is disposed on the support 36 side with respect to the carriage 38. The recording head 39 performs recording on the medium M by discharging the liquid as droplets on the medium M supported by the support 36.

As illustrated in FIG. 2, the main body 11 includes a transport unit 45 in the housing 12. The transport unit 45 transports the medium M fed from the roll body R. The transport unit 45 includes a transport path forming portion 46, an intermediate roller 47, and a transport roller 48.

The transport path forming portion 46 is provided corresponding to each roll body R. The transport path forming portion 46 is located on the rear wall 14 side with respect to each roll body R accommodated in the receiving portion 110. The transport path forming portion 46 forms a transport path 49 that guides the medium M fed from the roll body R toward the rear wall 14 side of the housing 12.

The intermediate roller 47 and the transport roller 48 transport the medium M that has passed through the transport path 49. The intermediate roller 47 and the transport roller 48 are constituted by a driving roller and a driven roller, which are a pair of rollers rotatably supported with an axis along the width direction as a rotation axis. The intermediate roller 47 and the transport roller 48 support the medium M by sandwiching the medium M between the driving roller and the driven roller from both the front and back sides thereof.

The transport unit 45 transports the medium M to the support 36 via the transport path 49 and transports the medium M from the rear wall 14 side to the front wall 13 side on the support 36 by rotating and driving the intermediate roller 47 and the transport roller 48 by the forward driving of the driving motor (not illustrated). Note that FIG. 2 illustrates a state in which the medium M is delivered from both roll bodies R, but during actual recording, the medium M is delivered from only one roll body R.

As illustrated in FIG. 2, the main body 11 has a paper discharge port member 50 and a cutting unit 51 in the housing 12. The paper discharge port member 50 is located on the front wall 13 side with respect to the support 36, supports the medium M passing through the support 36, and guides the medium M to a discharge paper port 53 formed at the front wall 13. The cutting unit 51 cuts the medium M. The medium M cut by the cutting unit 51 is discharged from the discharge paper port 53.

Figure 3:
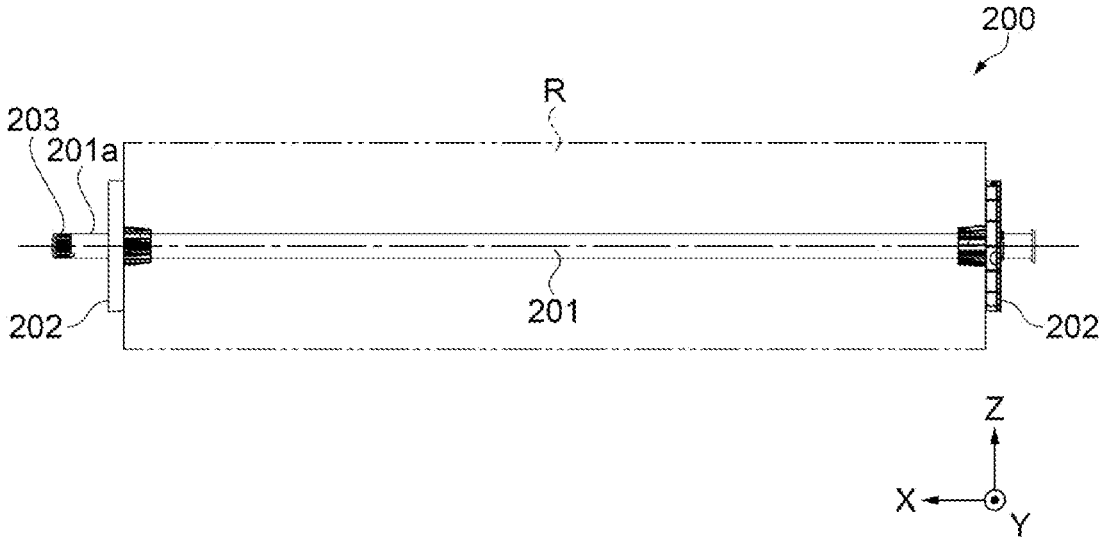
FIG. 3 is a schematic view illustrating a configuration of a spindle.

Here, as illustrated in FIG. 3, the spindle 200 includes a rod-shaped shaft portion 201 extending through the roll body R along the width direction, a holding unit 202 that is installed at the shaft portion 201 and holds down both ends in the width direction of the roll body R, and a driven gear 203 provided at one end of the shaft portion 201. The driven gear 203 meshes with a drive gear 125 (FIG. 4) provided at the receiving portion 110 such that the spindle 200 rotates axially around the shaft portion 201.

In addition, since the medium M used in the present exemplary embodiment has a large-format size, the weight of the roll body R is relatively large (for example, approximately 15 kg). Thus, for example, a metal spindle 200 having conductivity is used to reliably hold the heavy roll body R.

In the medium supply device 100 that uses such a spindle 200, a safety function for preventing the entry of a user's finger into a rotating portion of the driven gear 203, and an antistatic function of the spindle 200 are required. The medium supply device 100 according to the present exemplary embodiment is configured to include the safety function and the antistatic function.

Hereinafter, the detailed configuration of the medium supply device 100 will be described.

Figure 4:
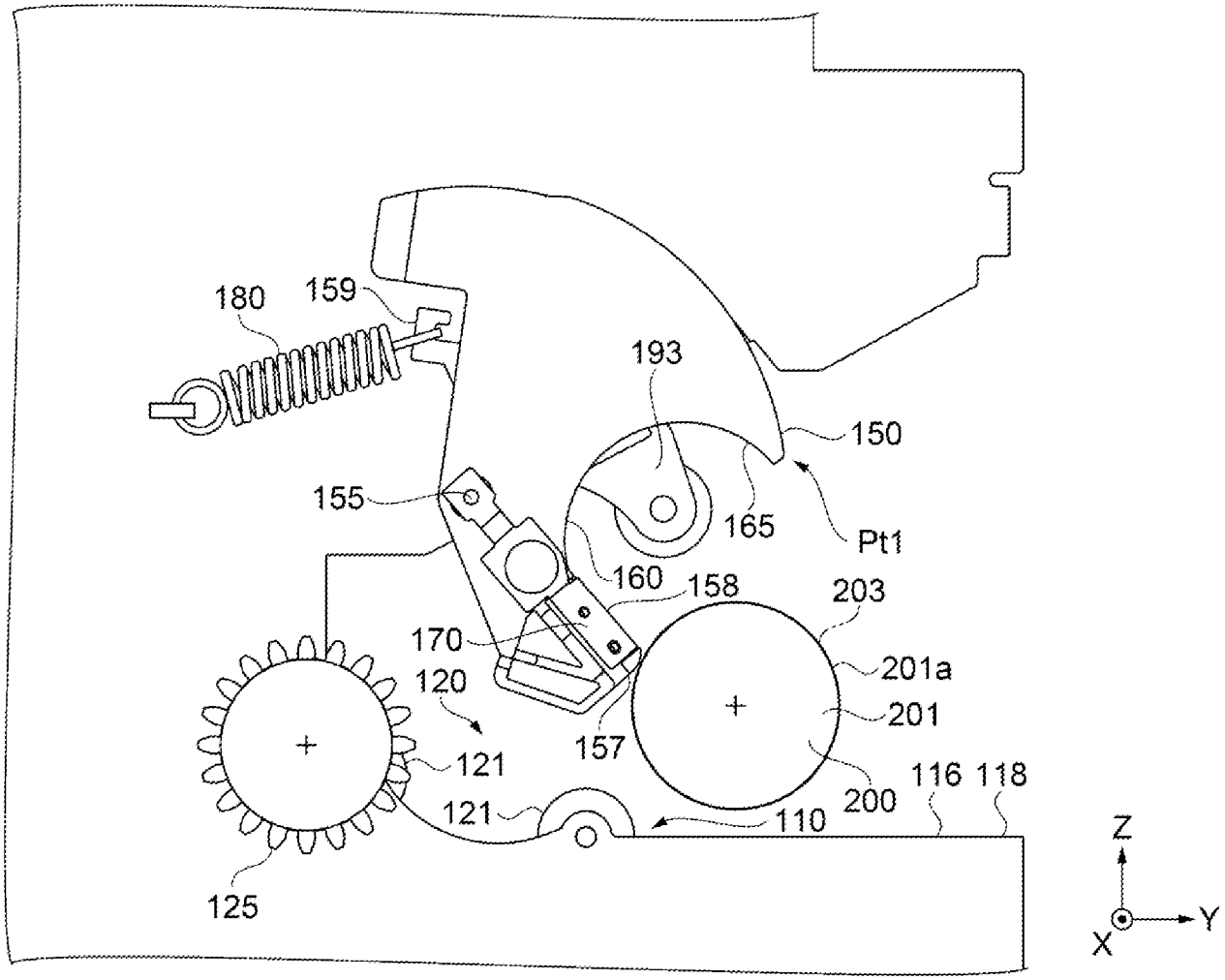
FIG. 4 is a side view illustrating a configuration of a receiving portion and a displacement member.
Figure 5:
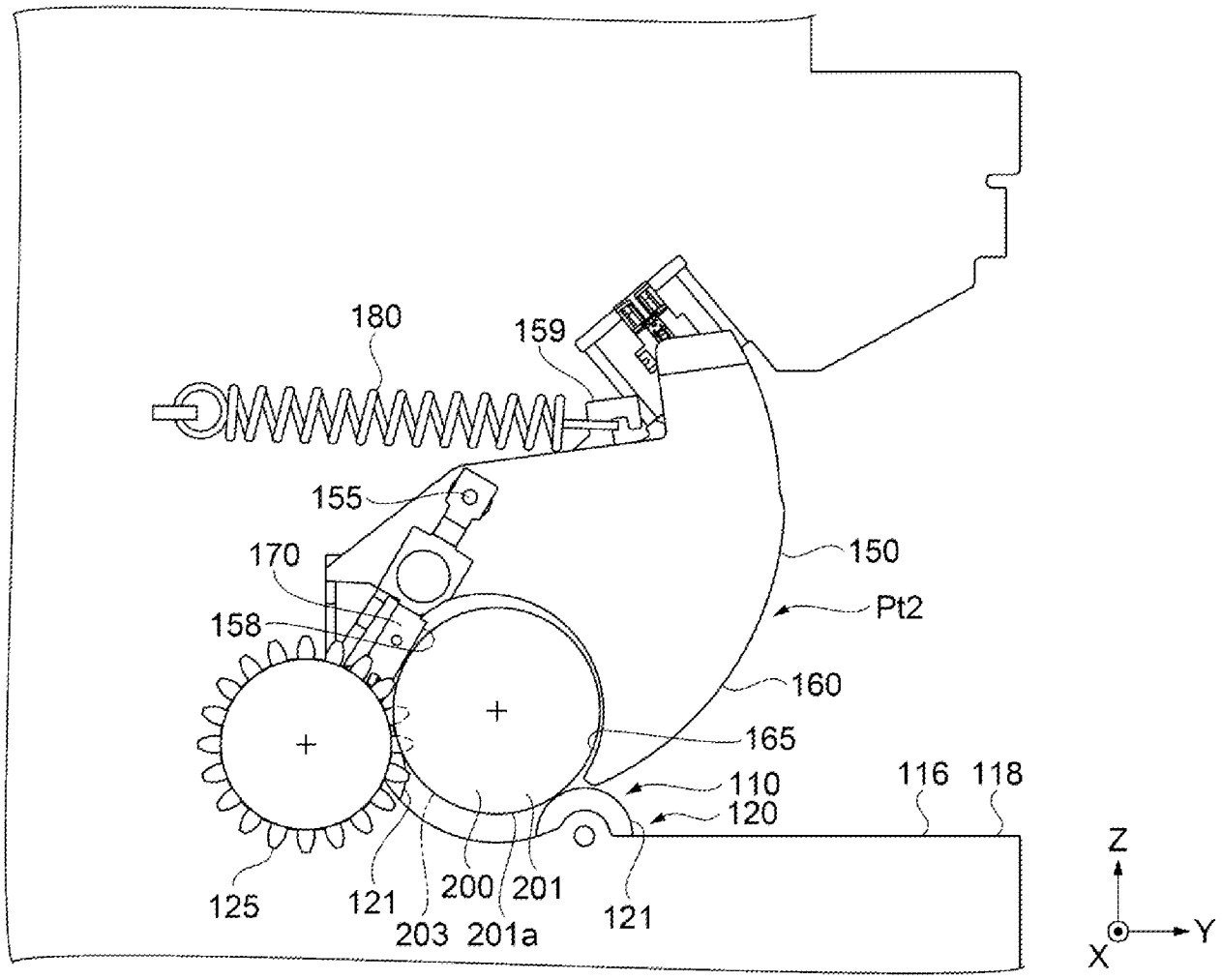
FIG. 5 is a side view illustrating the configuration of the receiving portion and the displacement member.

As illustrated in FIGS. 4 and 5, the medium supply device 100 includes the receiving portion 110 and a displacement member 150.

The receiving portion 110 receives the electrically conductive spindle 200 made of metal that holds the roll body R on which the medium M is wound. The receiving portion 110 is provided at the first side frame 116 and the second side frame 117. Hereinafter, the receiving portion 110 provided at the first side frame 116 will be described as an example.

The displacement member 150 is a member having a substantially pickaxe shape when viewed in the −X direction. The displacement member 150 is disposed at the receiving portion 110 and is a member displaceable to an advanced position Pt2 (FIG. 5) at which the spindle 200 (driven gear 203 portion) is covered and a retracted position Pt1 (FIG. 4) at which the spindle 200 (driven gear 203 portion) is exposed.

Figure 6:
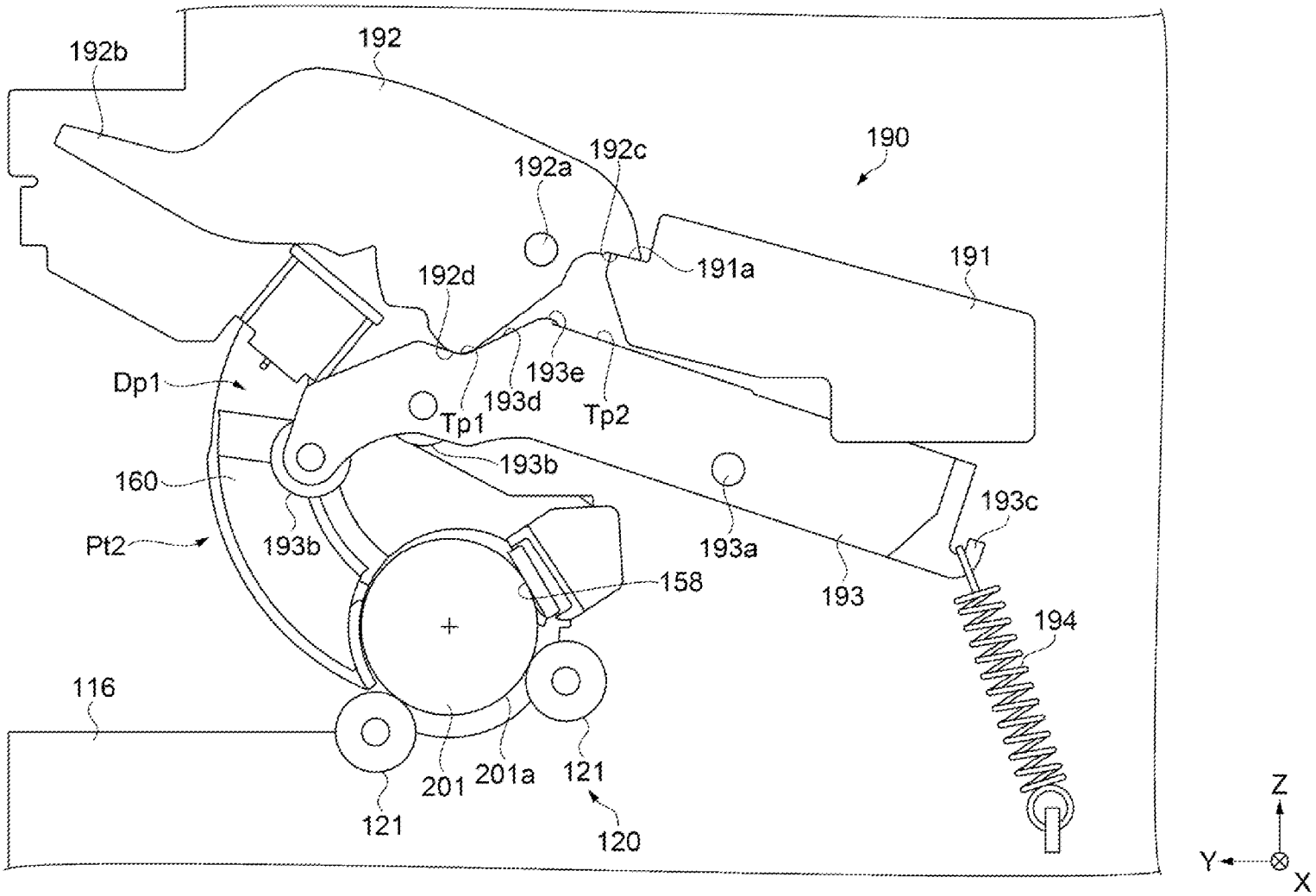
FIG. 6 is a schematic view illustrating a configuration of a locking mechanism.

The receiving portion 110 includes a support portion 120 that supports the shaft portion 201 of the spindle 200. As illustrated in FIG. 6, the support portion 120 abuts an outer peripheral surface 201*a* of the shaft portion 201 of the spindle 200 to rotatably support the spindle 200 around the shaft portion 201. The support portion 120 supports the shaft portion 201 of the spindle 200 from below.

Each support portion 120 of the present exemplary embodiment is constituted by a plurality (two in the present exemplary embodiment) of rollers 121. The rollers 121 are driven rollers. This may reduce the pivoting resistance as the shaft portion 201 of the spindle 200 rotates.

The receiving portion 110 also includes the drive gear 125 that meshes with the driven gear 203 of the spindle 200 to rotate the spindle 200 around the axis.

The drive gear 125 is driven forward by the driving motor to rotate the shaft portion 201 of the spindle 200. As a result, the roll body R rotates, and the medium M fed from the roll body R is transported in the transport direction by the transport unit 45.

Note that in the present exemplary embodiment, the driven gear 203 of the spindle 200 is provided only at one end of the shaft portion 201, and the drive gear 125 is provided only at the first side frame 116 at which the driven gear 203 is disposed.

The displacement member 150 is a member for covering the driven gear 203 of the spindle 200.

The displacement member 150 includes a pivoting shaft 155. The pivoting shaft 155 extends in a direction along the X-axis and is coupled to the first side frame 116. As a result, the displacement member 150 is pivotable to the advanced position Pt2 and the retracted position Pt1 around the pivoting shaft 155 with respect to the receiving portion 110 (first side frame 116).

Then, in a state where the spindle 200 is set in the receiving portion 110, the axial direction in which the shaft portion 201 of the spindle 200 extends and the axial direction in which the pivoting shaft 155 extends are the same, and both are the directions along the X-axis. As a result, the set direction of the spindle 200 to the receiving portion 110 and the rotating movement of the displacement member 150 can be easily synchronized, making it possible to simplify the configuration of the medium supply device 100 and increase the efficiency of the operation.

In addition, the displacement member 150 includes a cover portion 160. The cover portion 160 is a portion that covers the driven gear 203 at the advanced position Pt2. More specifically, at the advanced position Pt2, the cover portion 160 moves toward the +Y direction side of the driven gear 203 and covers the driven gear 203.

Figure 7:
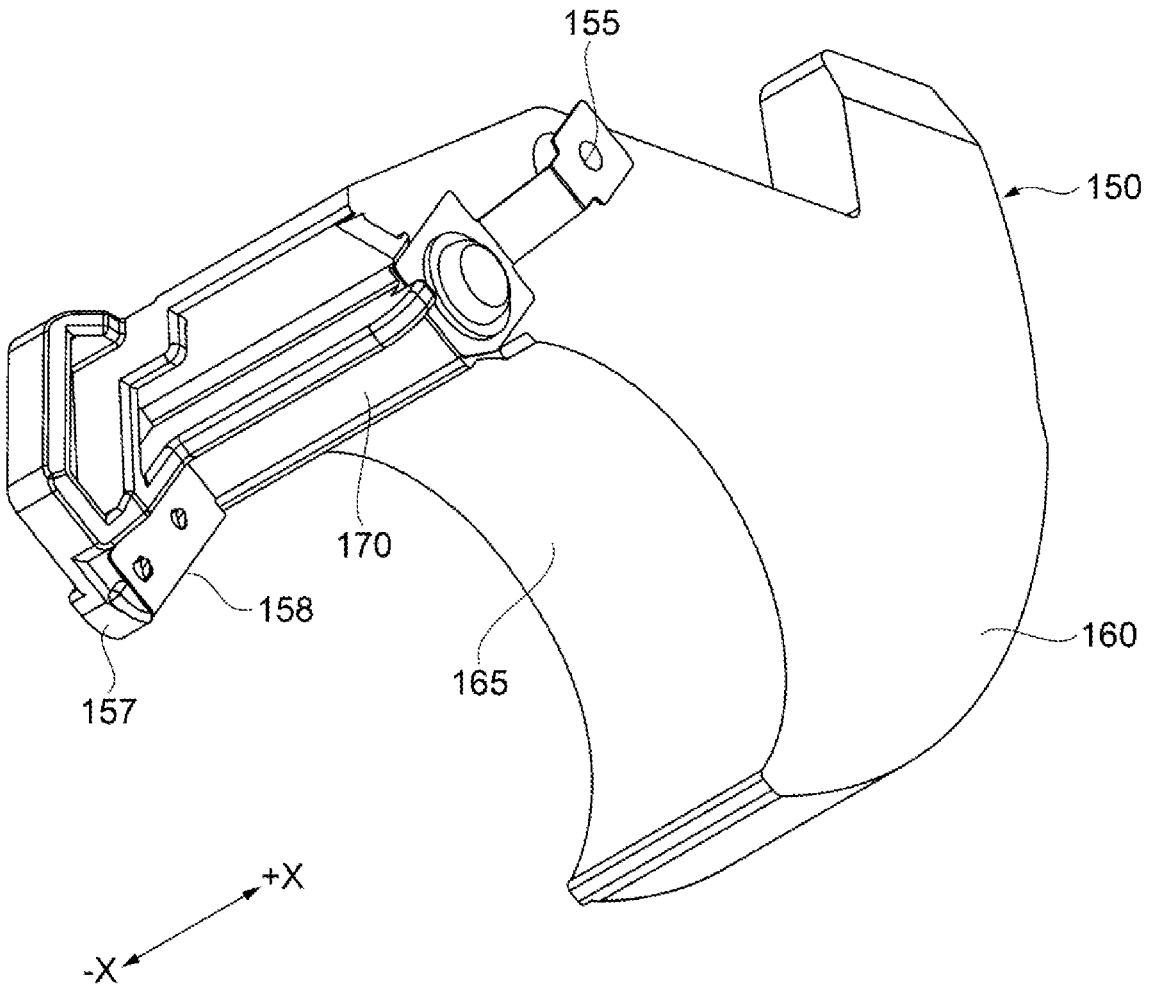
FIG. 7 is a perspective view illustrating a configuration of the displacement member.

At the advanced position Pt2, a portion of the cover portion 160 corresponding to the outer periphery of the driven gear 203 has a curved portion 165 that curves along the outer periphery of the driven gear 203. The curved portion 165 has a curved surface. As illustrated in FIG. 7, the width dimension of the curved portion 165 in the direction along the X-axis is substantially the same as the width dimension in the direction along the X-axis of the driven gear 203. As a result, the cover portion 160 can overlap with the entire driven gear 203 and cover the driven gear 203 when viewed in the −Y direction.

Here, the +X direction end of the driven gear 203 is covered by the first side wall 15 of the housing 12, and the −Y direction side of the driven gear 203 is covered by the rear wall 14 of the housing 12. In addition, the cover portion 160 can cover the +Z direction side and the +Y direction side of the driven gear 203 to prevent entry of the finger into the rotating portion of the driven gear 203 of the spindle 200.

Furthermore, by providing the curved portion 165 at a portion of the cover portion 160 facing the driven gear 203, the gap between the outer periphery of the driven gear 203 and the cover portion 160 is reduced, whereby the safety can be further increased. In other words, the safety function of the medium supply device 100 is ensured.

The medium supply device 100 includes an imparting member 180. The imparting member 180 is a member that imparts, to the displacement member 150, a force toward the retracted position Pt1. The imparting member 180 of the present exemplary embodiment is a tension spring. One end of the imparting member 180 is coupled to the first side frame 116, and the other end of the imparting member 180 is coupled to a hook portion 159 provided at the displacement member 150.

When the displacement member 150 is located at the retracted position Pt1 (FIG. 4), the imparting member 180 is in a contracted state. When the displacement member 150 is located at the advanced position Pt2 (FIG. 5), the imparting member 180 is in an extended state, and a force is imparted to the displacement member 150 toward the retracted position Pt1. This makes it possible to easily displace the displacement member 150 from the advanced position Pt2 to the retracted position Pt1. Note that the weight of the roll body R is overwhelmingly greater than respect to the tensile strength of the imparting member 180, so that the displacement member 150 is not displaced to the retracted position Pt1 in a state where the spindle 200 is set in the receiving portion 110 and the displacement member 150 is located at the advanced position Pt2.

The displacement member 150 also includes an abutting portion 157 that abuts the outer peripheral surface 201*a* of the shaft portion 201 of the spindle 200 when the spindle 200 is installed at the receiving portion 110, and pivots the displacement member 150 from the retracted position Pt1 to the advanced position Pt2 around the pivoting shaft 155.

As illustrated in FIG. 4, the abutting portion 157 is a portion protruding in the +Y direction in a state where the displacement member 150 is at the retracted position Pt1. Additionally, the abutting portion 157 is disposed in the −Z direction and the +Y direction relative to the pivoting shaft 155. Additionally, the abutting portion 157 is disposed in the −Z direction relative to the curved portion 165. The abutting portion 157 is provided in the −X direction relative to the cover portion 160 to prevent interference with the driven gear 203 of the spindle 200.

Then, as the spindle 200 progresses toward the abutting portion 157, the outer peripheral surface 201*a* of the shaft portion 201 on the +X direction end portion side of the spindle 200 contacts the abutting portion 157. Furthermore, when the spindle 200 is moved in the −Y direction, the abutting portion 157 moves in the −Y direction due to the pressing pressure of the spindle 200, and the curved portion 165 moves in the −Z direction, and the displacement member 150 moves in the clockwise direction around the pivoting shaft 155 when viewed in the −X direction. At this time, the displacement member 150 moves in the clockwise direction against the tensile force imparted by the imparting member 180.

The spindle 200 is then moved further in the −Y direction while pressing the abutting portion 157, and the shaft portion 201 is supported by the rollers 121 of the receiving portion 110. As a result, as illustrated in FIG. 5, the displacement member 150 is displaced to the advanced position Pt2. Then, the driven gear 203 meshes with the drive gear 125 and is covered by the cover portion 160.

The abutting portion 157 functions as a trigger for displacement of the displacement member 150 from the retracted position Pt1 to the advanced position Pt2 when the spindle 200 is set in the receiving portion 110.

The displacement member 150 has an opposing portion 158. As illustrated in FIGS. 5 and 6, at the advanced position Pt2, the opposing portion 158 abuts the outer peripheral surface 201*a* of the shaft portion 201 of the spindle 200 installed at the receiving portion 110. The opposing portion 158 has a flat surface, and the flat surface abuts the outer peripheral surface 201*a* of the shaft portion 201. The opposing portion 158 is provided near the abutting portion 157, and the opposing portion 158 is disposed closer to the pivoting shaft 155 than the abutting portion 157. The opposing portion 158 is provided in the −X direction relative to the cover portion 160 to prevent interference with the driven gear 203 at the advanced position Pt2.

At the advance position Pt2, the opposing portion 158 abuts the outer peripheral surface 201*a* of the shaft portion 201 at a position above the support portion 120 and higher than a center position of the shaft portion 201. More particularly, at the advanced position Pt2, the opposing portion 158 is located above the two rollers 121. This may ensure that the spindle 200 is held.

Note that when the spindle 200 is moved in the +Y direction from the state of the advanced position Pt2 and the spindle 200 is separated from the receiving portion 110, the restricting force caused by the spindle 200 of the displacement member 150 is lost, and the displacement member 150 is displaced to the retracted position Pt1 due to the biasing force of the imparting member 180.

Next, the configuration of a locking mechanism 190 will be described.

The medium supply device 100 is provided with the locking mechanism 190 for preventing floating of the spindle 200 relative to the support portion 120 when the spindle 200 is set in the receiving portion 110. The locking mechanism 190 is provided corresponding to both ends of the shaft portion 201 of the spindle 200. In other words, the locking mechanism 190 is provided at the first side frame 116 and the second side frame 117. Note that, in the exemplary embodiment, the configuration of the locking mechanism 190 at one side (the first side frame 116 side) will be described, and a description of the configuration of the locking mechanism 190 at the other side is omitted.

Figure 8:
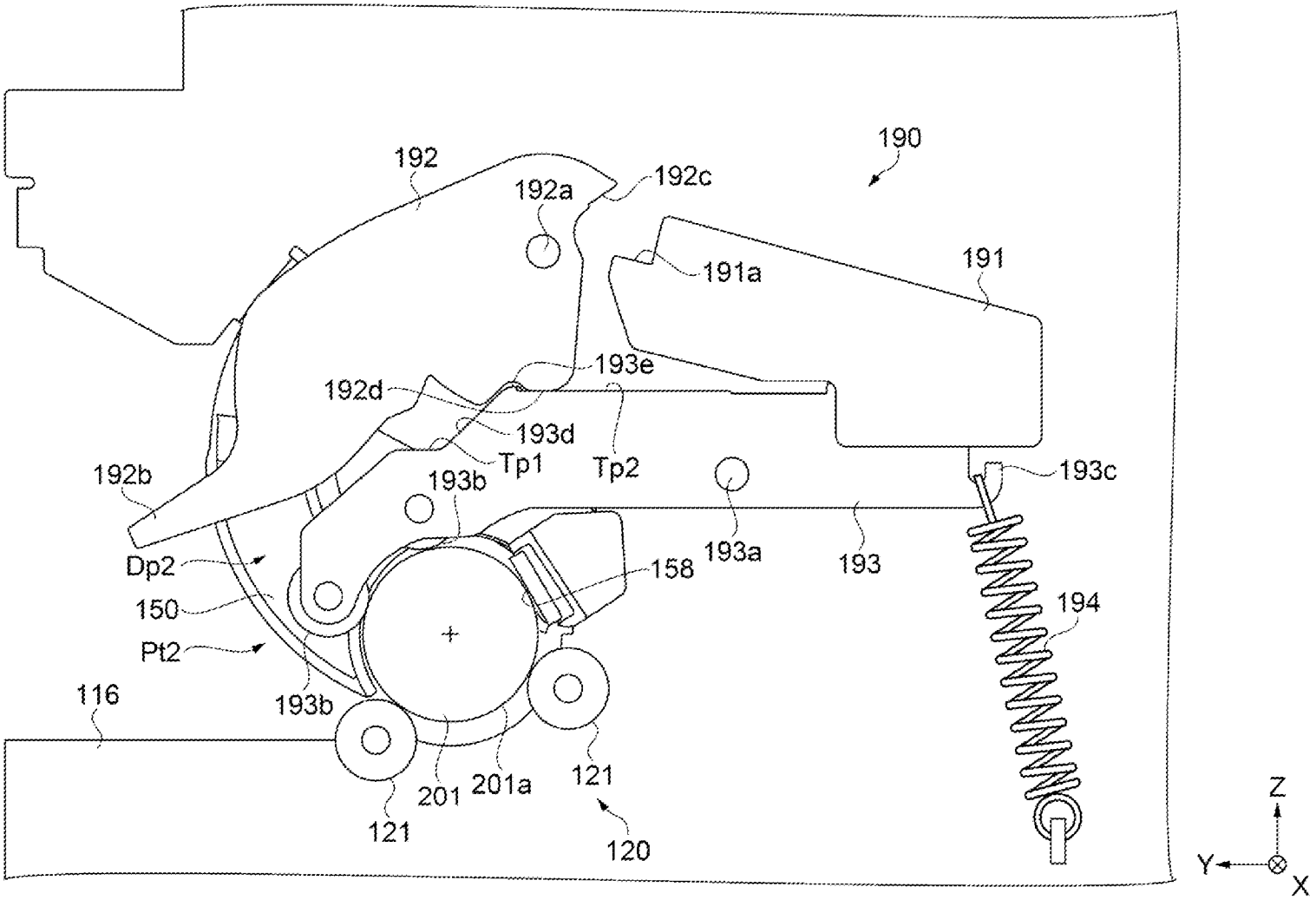
FIG. 8 is a schematic view illustrating the configuration of the locking mechanism.

As illustrated in FIGS. 6 and 8, the locking mechanism 190 is configured to abut the outer peripheral surface 201*a* of the shaft portion 201 of the spindle 200 and abuts the shaft portion 201 at a position opposite the support portion 120. That is, the locking mechanism 190 abuts the shaft portion 201 from above.

The locking mechanism 190 includes a fixing portion 191, a lever portion 192, and a pressing portion 193. The fixing portion 191 forms a block shape and is fixed to the first side frame 116.

The lever portion 192 is disposed in the +Y direction of the fixed portion 191. The lever portion 192 is configured to be rotatable around a shaft 192*a* fixed to the first side frame 116. A pinch portion 192*b* is provided at the +Y direction end of the lever portion 192 with respect to the shaft 192*a*. When the finger of the hand is hung on the pinch portion 192*b* and the pinch portion 192*b* is moved upward, as illustrated in FIG. 6, the lever portion 192 rotates in the clockwise direction around the shaft 192*a* when viewed in the +X direction. In addition, when the finger of the hand is hung on the pinch portion 192*b* and the pinch portion 192*b* is moved downward, as illustrated in FIG. 8, the lever portion 192 rotates in the counterclockwise direction around the shaft 192*a* when viewed in the +X direction.

A protrusion portion 192*c* that protrudes in the −Y direction is provided in the −Y direction with respect to the shaft 192*a* of the lever portion 192. On the other hand, a restricting portion 191*a* protruding in the +Y direction is provided in the +Y direction of the fixing portion 191. The protrusion portion 192*c* and the restricting portion 191*a* of the lever portion 192 are configured to be abutted and spaced apart. In other words, when the pinch portion 192*b* is moved upward, the lever portion 192 rotates in the clockwise direction around the shaft 192*a*, and when the protrusion portion 192*c* abuts the restricting portion 191*a*, rotation of the lever portion 192 in the clockwise direction is restricted. On the other hand, when the pinch portion 192*b* is moved downward, the lever portion 192 rotates in the counterclockwise direction around the shaft 192*a*, and the protrusion portion 192*c* and the restricting portion 191*a* are separated.

The pressing portion 193 is disposed below the lever portion 192. The pressing portion 193 is configured to be rotatable around a shaft 193*a* fixed to the first side frame 116. The shaft 193*a* is disposed in the −Y direction relative to the shaft 192*a* of the lever portion 192.

A driven roller 193*b* is provided at the +Y direction end with respect to the shaft 193*a* of the pressing portion 193. Two driven rollers 193*b* are disposed in the direction corresponding to the Y-axis. The driven roller 193*b* is disposed facing the rollers 121 of the support unit 120.

The pressing portion 193 is displaced from an abutting position Dp2 (FIG. 8) where the driven roller 193*b* abuts the outer peripheral surface 201*a* of the shaft portion 201, and a separation position Dp1 (FIG. 6) where the driven roller 193*b* is separated from the outer peripheral surface 201*a* of the shaft portion 201.

The pressing portion 193 is biased so that the pressing portion 193 is held at the separation position Dp1 by a tension spring 194. Specifically, one end of the tensile spring 194 is coupled to the first side frame 116, and the other end of the tensile spring 194 is coupled to the hook portion 193*c* provided at the −Y direction end of the pressing portion 193.

Then, the lever portion 192 and the pressing portion 193 are linked so that the pressing portion 193 is displaced to the abutting position Dp2 where the pressing portion 193 abuts the shaft portion 201 and the separation position Dp1 where the pressing portion 193 is separated from the shaft portion 201.

Specifically, a convex portion 192*d* is provided below the shaft 192*a* of the lever portion 192 and protrudes toward the pressing portion 193. Meanwhile, a first contact point Tp1 and a second contact point Tp2 that abut the convex portion 192*d* of the lever portion 192 are provided above the pressing portion 193. The second contact point Tp2 is disposed in the +Z direction with respect to the first contact point Tp1. A slope 193*d* is provided between the first contact point Tp1 and the second contact point Tp2. Furthermore, a small protrusion portion 193*e* that protrudes upward is provided between the slope 193*d* and the second contact point Tp2.

When the pressing portion 193 is at the separation position Dp1, the convex portion 192*d* of the lever portion 192 is located at the first contact point Tp1. On the other hand, when the pressing portion 193 is at the abutting position Dp2, the convex portion 192*d* of the lever portion 192 is located at the second contact point Tp2.

Next, the operation of the locking mechanism 190 will be described. First, the operation of displacing the locking mechanism 190 from the separation position Dp1 to the abutting position Dp2 will be described.

As illustrated in FIG. 6, the spindle 200 is set in the support unit 120 of the receiving portion 110. Next, the pinch portion 192*b* of the lever portion 192 of the locking mechanism 190 is moved downward. As a result, the lever portion 192 rotates in the counterclockwise direction around the shaft 192*a*.

Rotation of the lever portion 192 causes the convex portion 192*d* of the lever portion 192 to move from the first contact point Tp1 toward the second contact point Tp2 along the slope 193*d*. As a result, the pressing portion 193 rotates in the counterclockwise direction around the shaft 193*a*.

Furthermore, when the lever portion 192 is rotated, the convex portion 192*d* of the lever portion 192 reaches the second contact point Tp2 from the slope 193*d* over the protrusion portion 193*e*. As a result, as illustrated in FIG. 8, the pressing portion 193 is displaced to the abutting position Dp2, and the driven roller 193*b* abuts the shaft portion 201 of the spindle 200.

Note that the pressing portion 193 is biased in the clockwise direction by the tension spring 194. However, the protrusion portion 193*e* of the pressing portion 193 becomes an obstacle, and the movement of the convex portion 192*d* of the lever portion 192 in the clockwise direction is restricted. As a result, when the convex portion 192*d* of the lever portion 192 is located at the second contact point Tp2, the pressing portion 193 is held in the abutting position Dp2, and lifting of the spindle 200, etc. is suppressed.

Next, the operation of displacing the locking mechanism 190 from the abutting position Dp2 to the separation position Dp1 will be described.

As illustrated in FIG. 8, when the locking mechanism 190 is at the abutting position Dp2, the pinch portion 192*b* of the lever portion 192 is moved upward. As a result, the lever portion 192 rotates in the clockwise direction around the shaft 192*a*.

Rotation of the lever portion 192 causes the convex portion 192*d* of the lever portion 192 to move from the second contact point Tp2 over the protrusion portion 193*e* so as to follow the slope 193*d* and move toward the first contact point Tp1. As a result, the pressing portion 193 rotates in the clockwise direction around the shaft 193*a*.

Furthermore, when the lever portion 192 is rotated, the convex portion 192*d* of the lever portion 192 reaches the first contact point Tp1. As a result, the pressing portion 193 rotates in the clockwise direction around the shaft 193*a* due to the biasing force of the tension spring 194. As a result, as illustrated in FIG. 6, the pressing portion 193 is displaced to the separation position Dp1, and the driven roller 193*b* is separated from the shaft portion 201 of the spindle 200. In addition, the protrusion portion 192*c* of the lever portion 192 abuts the restricting portion 191*a* of the fixing portion 191, and the position of the lever portion 192 is held by being pressed from below into the pressing portion 193.

Movement of the locking mechanism 190 to the separation position Dp1 allows removal of the spindle 200 from the receiving portion 110.

Next, a ground member 170 will be described.

As illustrated in FIGS. 4, 5, and 7, the displacement member 150 includes the grounding member 170. At the advanced position Pt2 of the displacement member 150, the grounding member 170 contacts the spindle 200 and couples to the ground potential. The grounding member 170 of the present exemplary embodiment is a plate-shaped conductive member (SUS material, for example).

The grounding member 170 is coupled to the pivoting shaft 155 and is configured to be pivotable with the displacement member 150. The pivoting shaft 155 is coupled to the first side frame 116 (sheet metal), and the potential of the spindle 200 may be approximately equal to the potential of the medium supply device 100 (recording device 10).

At least a portion of the grounding member 170 is provided at the opposing portion 158 and the abutting portion 157. In other words, the grounding member 170 is disposed crawling on the outer peripheral surface of the displacement member 150 from the pivoting shaft 155 to the opposing portion 158 and the abutting portion 157. As a result, when the spindle 200 is set in the receiving portion 110, the spindle 200 abuts the grounding member 170 at the position of the abutting portion 157, so it is possible to minimize the effect of the electrostatic charge at the early stage of the movement process.

In the present exemplary embodiment, at the advanced position Pt2 of the displacement member 150, the grounding member 170 contacts the outer peripheral surface 201*a* of the shaft portion 201 of the spindle 200 at the position of the opposing portion 158. This allows the grounding member 170 and the spindle 200 to come into contact in a stable state.

Therefore, in addition to the safety function, the medium supply device 100 can ensure the antistatic function.

The grounding member 170 of the present exemplary embodiment is provided at the displacement member 150. In other words, the grounding member 170 is not disposed on the receiving portion 110 side. Thus, when setting the spindle 200 in the receiving portion 110, the spindle 200 may not unintentionally contact the grounding member 170 and damage/deform the grounding member 170. Accordingly, the spindle 200 may be reliably grounded.

In addition, the displacement member 150 is imparted with a force toward the retracted position Pt1 by the imparting member 180. Accordingly, at the advanced position Pt2 of the displacement member 150, the portion of the grounding member 170 that contacts the spindle 200 is biased toward the shaft portion 201, making it possible to reliably make contact between the grounding member 170 and the spindle 200.

Note that in the present exemplary embodiment, the configuration of the grounding member 170 is a plate shape, but the present disclosure is not limited thereto. For example, the displacement member 150 may be a flat spring shaped elastic body. In other words, the ground member 170 may be configured to elastically contact the outer peripheral surface 201*a* around the shaft portion 201 of the spindle 200.

In this way, the grounding member 170 may be more easily brought into contact with the spindle 200 and more reliably ground.

In the present exemplary embodiment, the ground member 170 is configured to contact the shaft portion 201 of the spindle 200, but the present disclosure is not limited thereto. For example, contact with the spindle 200 may be an end surface of an end of the shaft portion 201.

Next, the configuration of a detecting unit 140 will be described.

The detecting unit 140 is provided at the receiving portion 110 to detect the presence or absence of the spindle 200 in the receiving portion 110. The detecting unit 140 is coupled to the control unit, and the control unit drives the drive gear 125 in a case where the control unit determines that the spindle 200 is present in the receiving portion 110 based on a detection signal from the detecting unit 140. This causes the shaft portion 201 of the spindle 200 to rotate around the axis and begin feeding the medium M. On the other hand, the control unit stops driving the drive gear 125 in a case where the control unit determines that the spindle 200 is not present in the receiving portion 110 based on the detection signal from the detecting unit 140. This stops rotation of the spindle 200 and stops the supply of the medium M.

Figure 9:
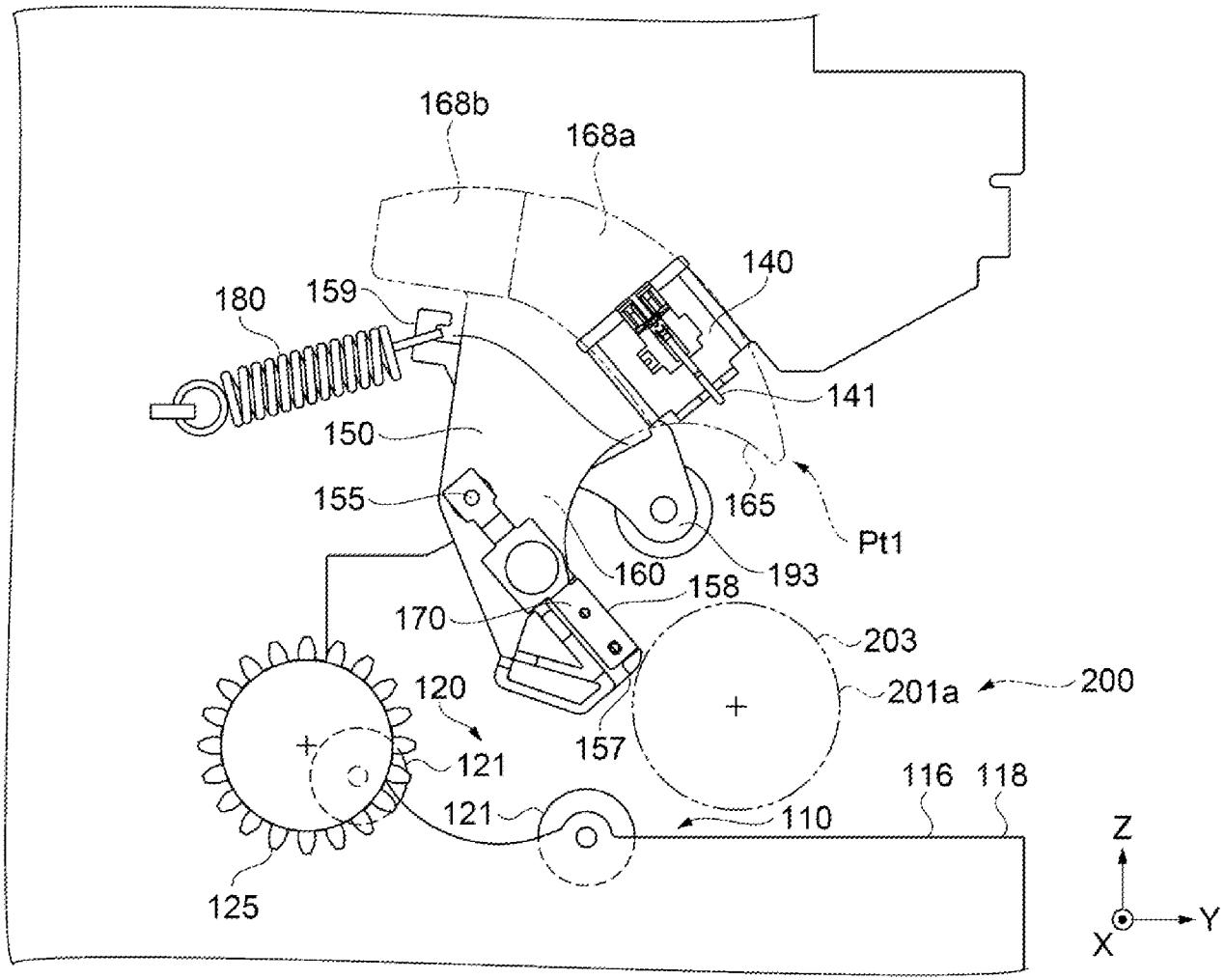
FIG. 9 is a schematic view illustrating a configuration of a detecting unit.
Figure 10:
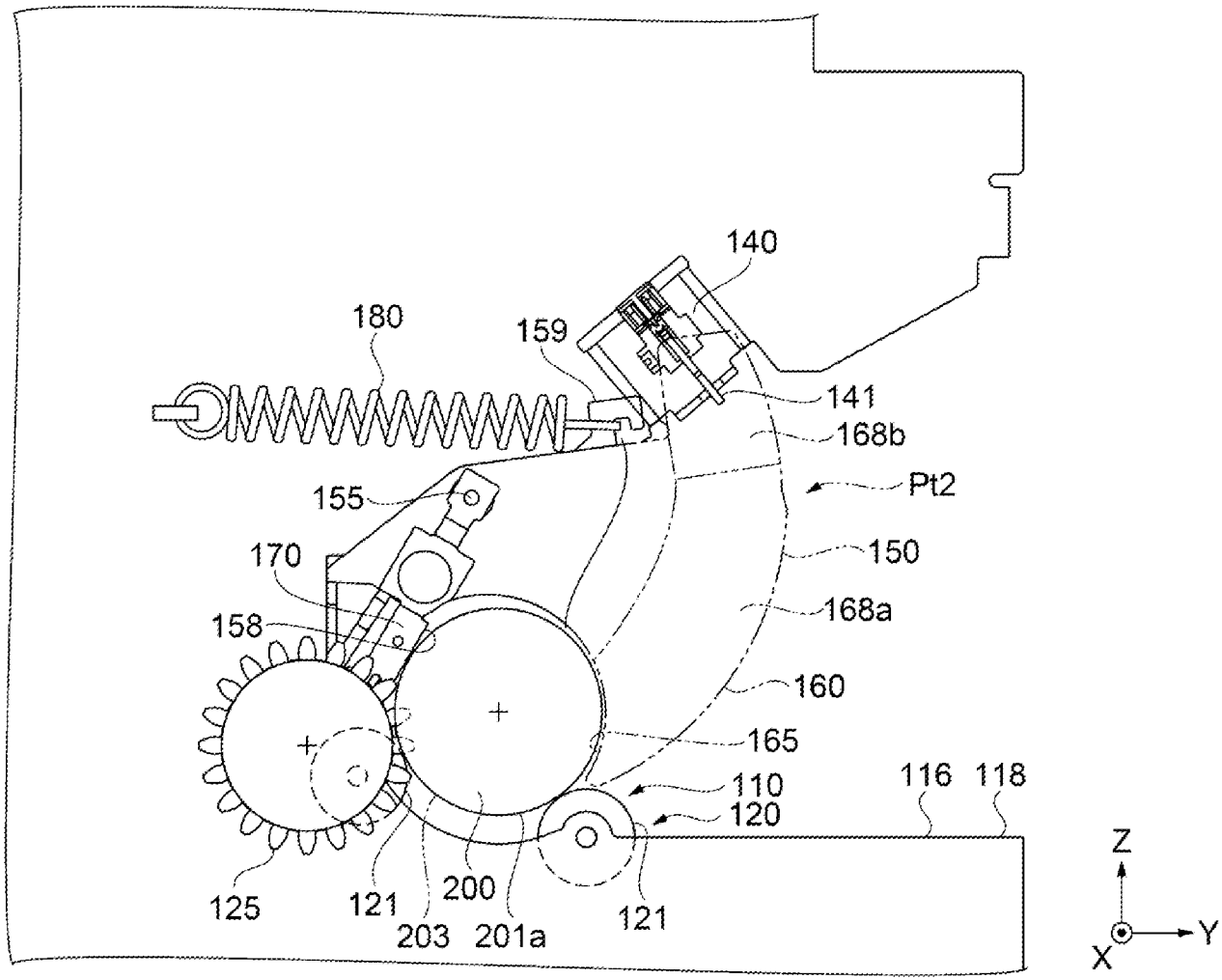
FIG. 10 is a schematic view illustrating the configuration of the detecting unit.

As illustrated in FIGS. 9 and 10, the detecting unit 140 is disposed at a position corresponding to the displacement member 150 of the first side frame 116. The detecting unit 140 according to the present exemplary embodiment is a microswitch provided with a switch unit 141, and converts mechanical motion by the switch unit 141 into an electrical signal, and transmits the electrical signal as a detection signal to the control unit. The switch unit 141 is displaced in a direction along the X-axis.

Figure 11:
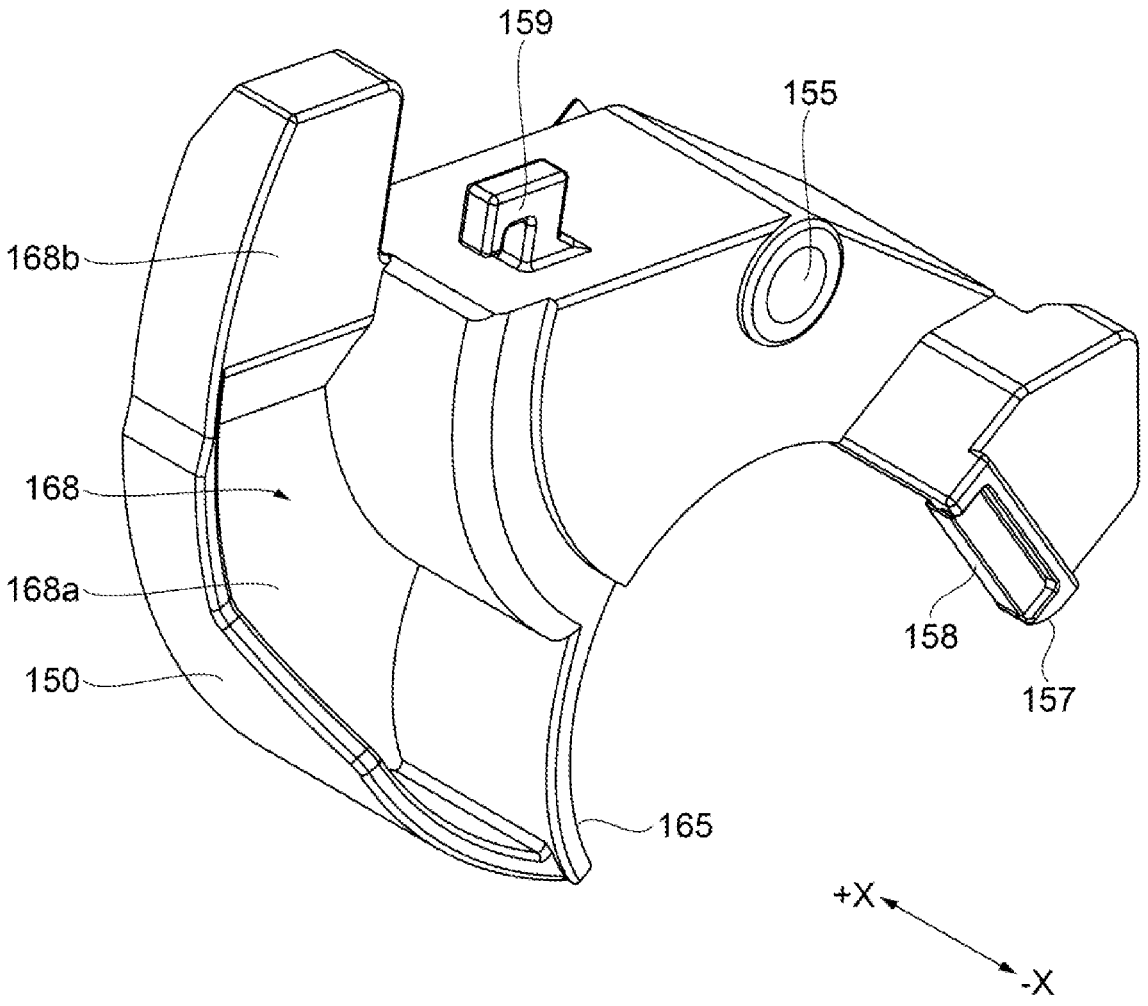
FIG. 11 is a perspective view illustrating a configuration of the displacement member (detected portion).

As illustrated in FIG. 11, the displacement member 150 includes a detected portion 168 formed with a step portion. The detected portion 168 is provided in the −X direction of the displacement member 150 facing the switch unit 141 of the detecting unit 140. More specifically, the detected portion 168 is provided in the −X direction of the cover portion 160.

The detected portion 168 includes the step portion, and the step portion includes a first detected surface 168*a* and a second detected surface 168*b*. In FIG. 11, the first detected surface 168*a* is disposed below the detected portion 168, and the second detected surface 168*b* is disposed above the detected portion 168.

The first detected surface 168*a* is disposed at a concave portion. The second detected surface 168*b* is disposed in the −X direction relative to the first detected surface 168*a*. In other words, the second detected surface 168*b* is disposed closer to the switch unit 141 than the first detected surface 168*a*.

When the displacement member 150 is displaced between the advanced position Pt2 and the retracted position Pt1, the detecting unit 140 detects the presence or absence of the spindle 200 by the positional relationship between the detecting unit 140 and the step portion (the first detected surface 168*a* and the second detected surface 168*b*) of the detected portion 168.

Specifically, as illustrated in FIG. 9, when the displacement member 150 is located at the retracted position Pt1, that is, in a state where the spindle 200 is not set in the receiving portion 110, the switch unit 141 of the detecting unit 140 faces the first detected surface 168*a*. In this case, since the switch unit 141 does not contact the first detected surface 168*a*, the switch unit 141 is not displaced (switch off state). In this way, the control unit determines that no spindle 200 is present.

On the other hand, as illustrated in FIG. 10, when the displacement member 150 is located at the advanced position Pt2, that is, in a state where the spindle 200 is set in the receiving portion 110, the switch unit 141 of the detecting unit 140 faces the second detected surface 168*b*. In this case, the switch unit 141 contacts the second detected surface 168*b* and is displaced in the −X direction (switch on state). In this way, the control unit determines that the spindle 200 is present.

Note that the detecting unit 140 may be an optical sensor. The optical sensor includes a light emitting portion and a light receiving portion. In addition, for example, a through-hole is provided at a portion of the detected portion 168. Furthermore, the configuration may be used to detect the presence or absence of the spindle 200 in accordance with the received amount of the displacement member 150 at the retracted position Pt1 and the advanced position Pt2. Even with this configuration, similar advantages as described above can be obtained.

In addition to the safety function and the antistatic function, the medium supply device 100 and the recording device 10 according to the present exemplary embodiment include the detection function capable of detecting the presence or absence of the spindle 200 at the receiving portion 110.

What is claimed is:

1. A medium supply device comprising:

a receiving portion configured to receive an electrically conductive spindle including a shaft portion extending through a roll body on which a medium is wound, the spindle being configured to hold the roll body; and a displacement member disposed at the receiving portion and configured to be displaced to an advanced position at which the spindle is covered and a retracted position at which the spindle is exposed, wherein the receiving portion includes a support portion abutting an outer peripheral surface of the shaft portion of the spindle and configured to rotatably support the spindle and a drive gear meshing with a driven gear provided at an end of the shaft portion of the spindle to rotate the spindle, and the displacement member includes:

a pivoting shaft configured to pivot between the advanced position and the retracted position;

an abutting portion abutting the outer peripheral surface of the shaft portion of the spindle when the spindle is installed at the receiving portion, the abutting portion being configured to cause the displacement member to pivot from the retracted position to the advanced position around the pivoting shaft;

an opposing portion abutting, at the advanced position, the outer peripheral surface of the shaft portion of the spindle installed at the receiving portion;

a cover portion configured to, at the advanced position, cover the driven gear; and a grounding member contacting, at the advanced position, the spindle, thereby coupling the spindle to a ground potential.

2. The medium supply device according to claim 1, wherein the receiving portion includes a detecting unit configured to detect the presence or absence of the spindle, the displacement member includes a detected portion formed with a step portion, and the detecting unit is configured to, when the displacement member is displaced between the advanced position and the retracted position, detect the presence or absence of the spindle based on a positional relationship between the detecting unit and the step portion of the detected portion.

3. The medium supply device according to claim 1, wherein at the advanced position, the opposing portion abuts an outer peripheral surface of the shaft portion of the spindle at a position above the support portion and higher than a central position of an axis of the spindle.

4. The medium supply device according to claim 1, wherein the cover portion includes a curved portion curving along an outer periphery of the driven gear of the spindle.

5. The medium supply device according to claim 1, wherein an axial direction of the spindle and an axial direction of the pivoting shaft of the displacement member are the same.

6. The medium supply device according to claim 1, wherein at the advanced position, the grounding member is configured to elastically contact an outer peripheral surface of the shaft portion of the spindle.

7. The medium supply device according to claim 1, wherein at least a portion of the grounding member is provided at the abutting portion.

8. The medium supply device according to claim 1, wherein the grounding member is coupled to the pivoting shaft and configured to pivot with the displacement member.

9. The medium supply device according to claim 1, comprising an imparting member configured to impart, to the displacement member, a force toward the retracted position.

10. The medium supply device according to claim 1, wherein the support portion includes two rollers.

11. A recording device comprising:

a receiving portion configured to receive an electrically conductive spindle including a shaft portion extending through a roll body on which a medium is wound, the spindle being configured to hold the roll body;

a displacement member disposed at the receiving portion and configured to be displaced to an advanced position at which the spindle is covered and a retracted position at which the spindle is exposed; and a recording unit configured to perform recording on the medium, wherein the receiving portion includes a support portion abutting an outer peripheral surface of the shaft portion of the spindle and configured to rotatably support the spindle, and a drive gear meshing with a driven gear provided at an end of the shaft portion of the spindle to rotate the spindle, and the displacement member includes:

a pivoting shaft configured to pivot between the advanced position and the retracted position;

an abutting portion abutting the outer peripheral surface of the shaft portion of the spindle when the spindle is installed at the receiving portion, the abutting portion being configured to cause the displacement member to pivot from the retracted position to the advanced position around the pivoting shaft;

an opposing portion abutting, at the advanced position, the outer peripheral surface of the shaft portion of the spindle installed at the receiving portion;

a cover portion configured to, at the advanced position, cover the driven gear; and a grounding member contacting, at the advanced position, the spindle, thereby coupling the spindle to a ground potential.

* * * * *